United States Patent [19]

Jackson

[11] Patent Number: 4,967,623

[45] Date of Patent: Nov. 6, 1990

[54] NAIL SUPPORT APPARATUS

[76] Inventor: Linda K. Jackson, P.O. Box 1771, Gary, Ind. 46409

[21] Appl. No.: 470,261

[22] Filed: Jan. 25, 1990

[51] Int. Cl.[5] ..... B25C 3/00

[52] U.S. Cl. ..... 81/44

[58] Field of Search ..... 81/44, 487, 23–24, 81/177.1, 177.8, 177.7, 177.6, 177.9; 16/110 R; 269/43–45; 30/286, 288, 295

[56] References Cited

U.S. PATENT DOCUMENTS

| | | | |
|---|---|---|---|
| 1,426,249 | 8/1922 | Bochonok | 81/44 |
| 1,688,445 | 10/1928 | Williams | 81/44 |
| 1,867,928 | 7/1932 | Smith | 81/44 |
| 4,093,008 | 6/1978 | Martin | 81/177.1 |
| 4,403,725 | 9/1983 | Lawrence | 81/44 X |
| 4,467,747 | 5/1987 | Falls et al. | 81/44 X |
| 4,784,025 | 11/1988 | Peck | 81/44 |

FOREIGN PATENT DOCUMENTS

| | | | |
|---|---|---|---|
| 13187 | of 1905 | United Kingdom | 30/315 |

*Primary Examiner*—D. S. Meislin
*Attorney, Agent, or Firm*—Leon Gilden

[57] ABSTRACT

An apparatus including an elongate cylindrical cellular handle formed with a forwardly directed and coaxially aligned extension rod mounting a magnetic head which is provided with a forwardly positioned and diametrically aligned groove which is orthogonally aligned with the extension rod. Modifications of the instant invention include the handle formed with a coaxial bearing to enable rotative repositioning of an individuals hand relative to the handle without removal of the individuals hand from the handle. Furthermore, resilient spring construction of the extension rod may be utilized to minimize shock transmission to the individuals hand during use and simultaneously minimize damage to the tool. Further, a multiple of spring wound extension rods may be utilized to secure a like plurality of nails to enable nailing at predetermined intervals without resort to measuring.

6 Claims, 5 Drawing Sheets

Fig 3
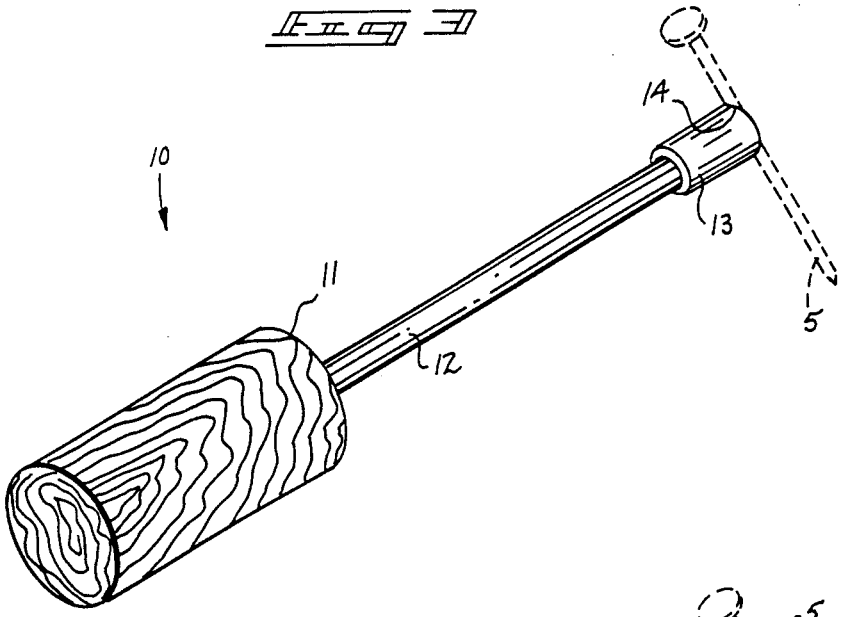
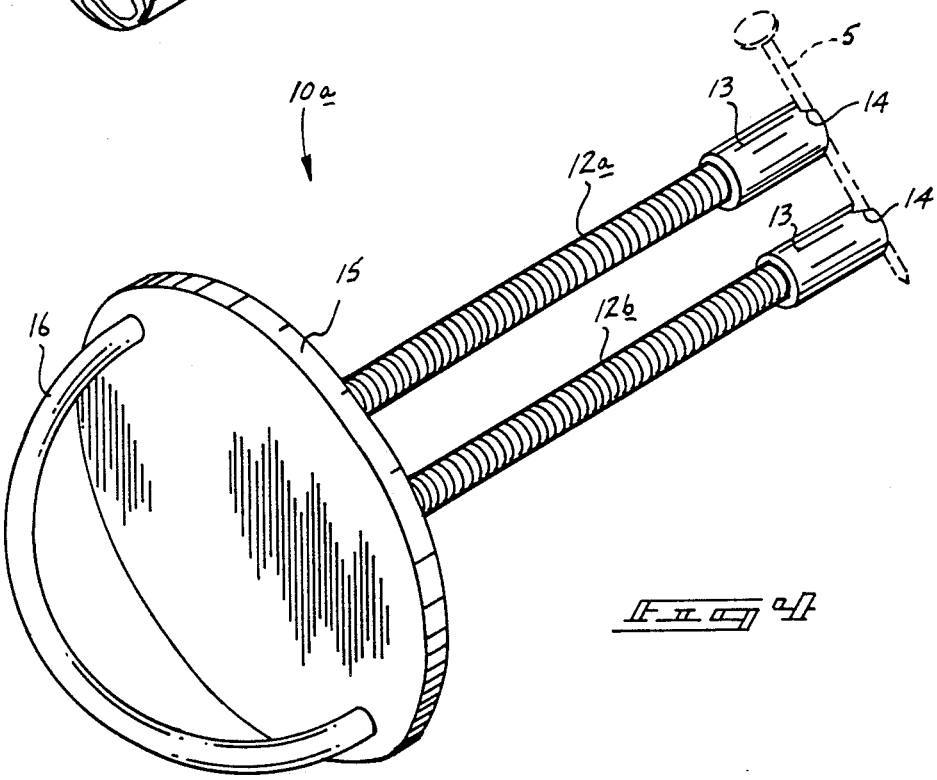
Fig 4

NAIL SUPPORT APPARATUS

BACKGROUND OF THE INVENTION

1. Field of the Invention

The field of the invention relates to nailing implements, and more particularly pertains to a new and improved nail support apparatus wherein the same magnetically secures and positions a nail member during a nailing procedure.

2. Description of the Prior Art

The use of nail securing apparatus to position a nail overlying a work piece prior to and during a nailing procedure has been provided in the prior art with the prior art, however, failing to set forth a convenient and simplified organization accommodating immediate and convenient securing of a nail for use in a nailing procedure. Examples of the prior art include BOCHONOK U.S. Pat. No. 1,426,249 wherein a handle member with an elongate rod utilizes spring clip members that are mounted to a forward end of the rod to secure nail therewithin. The patent fails to provide the convenience of a magnetic head as utilized by the instant invention.

FALLS et al U.S. Pat. No. 4,667,747 provides a nail holder formed with an arcuately displaced handle mounting a magnetic head at a forward end to secure a nail with an overlying pivoted hammering member overlying the nail head to orient the nail relative to the hammer.

WILLIAMS U.S. Pat. No. 1,688,445 provides a nail holder apparatus wherein a plurality of spaced jaws clamp a nail for nailing procedure.

SMITH U.S. Pat. No. 1,867,928 provides a nail holding tool with a clip member securing a nail therewithin in a forend of a support handle on a rod.

PECK U.S. Pat. No. 4,784,025 provides a handle with an arcuately formed extension rod mounting a nail holding member utilizing mechanical means to secure the nail within a formed slot.

As such, it may be appreciated that there continues to be a need for new and improved nail support apparatus which address the problems of ease of use, and effectiveness in construction to provide a nail holding fixture that is readily and immediately accommodating of a user's physical positioning relative to a nail to be driven.

SUMMARY OF THE INVENTION

In view of the foregoing disadvantages inherent in the known types of nail support apparatus now present in the prior art, the present invention provides an improved nail support apparatus wherein the same magnetically and fixedly secures a nail at a remote position relative to a user to enable driving of the nail simultaneously minimizing inadvertent striking of a user's hand during the nailing procedure. As such, the general purpose of the present invention, which will be described subsequently in greater detail, is to provide a new and improved nail support apparatus which has all the advantages of the prior art nail support apparatus and none of the disadvantages.

To attain this, the present invention to a nail support organization is set forth including an elongated cylindrical cellular handle formed with a forwardly directed and coaxially aligned extension rod mounting a magnetic head provided with a forwardly positioned and diametrically aligned groove which is orthogonally aligned with the extension rod. Modifications of the instant invention include the handle formed with a coaxial bearing to enable rotative positioning of an individual's hand relative to the handle without removal of the individual's hand from the handle. Furthermore, resilient spring construction of the extension rod may be utilized to minimize shock transmission to the individual's hand during use and simultaneously minimize damage to the tool. Further a multiple of spring wound extension rods may be utilized to secure a like plurality of nails to enable nailing at predetermined intervals without resort to measuring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved nail support apparatus which has all the advantages of the prior art nail support apparatus and none of the disadvantages.

It is another object of the present invention to provide a new and improved nail support apparatus which may be easily and efficiently manufactured and marketed.

It is a further object of the present invention to provide a new and improved nail support apparatus which is of a durable and reliable construction.

An even further object of the present invention is to provide a new and improved nail support apparatus which is susceptible of a low cost of manufacture with regard to both materials and labor, and which accordingly is then susceptible of low prices of sale to the consuming public, thereby making such nail support apparatuses economically available to the buying public.

Still yet another object of the present invention is to provide a new and improved nail support apparatus which provides in the apparatuses and methods of the prior art some of the advantages thereof, while simultaneously overcoming some of the disadvantages normally associated therewith.

Still another object of the present invention is to provide a new and improved nail support apparatus which may be compactly stored when not being utilized.

Yet another object of the present invention is to provide a new and improved nail support apparatus where the same provides a remotely positioned nail support head selectively mounting a nail to be driven.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an isometric illustration of a modified nail support apparatus utilized by the instant invention.

FIG. 7 is an isometric illustration of a modified application of the instant invention.

FIG. 8 is a top orthographic view of the modified invention of FIG. 7 utilizing rigid extension rods.

DESCRIPTION OF THE PREFERRED EMBODIMENT

Figure 1:
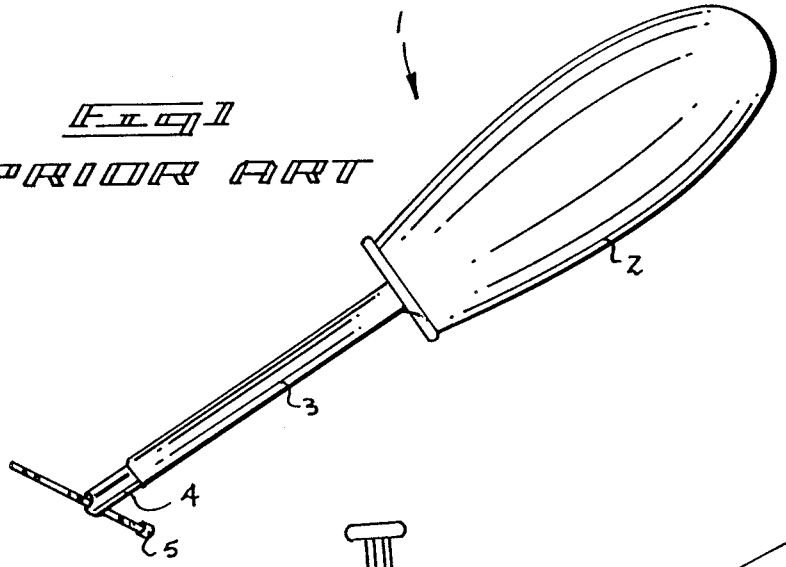
FIG. 1 PRIOR ART
FIG. 1 is an orthographic side view taken elevation of a prior art nail support apparatus.

With reference now to the drawings, and in particular to FIGS. 1 to 8 thereof, a new and improved nail support apparatus embodying the principles and concepts of the present invention and generally designated by the reference numeral 10 will be described.

Figure 2:
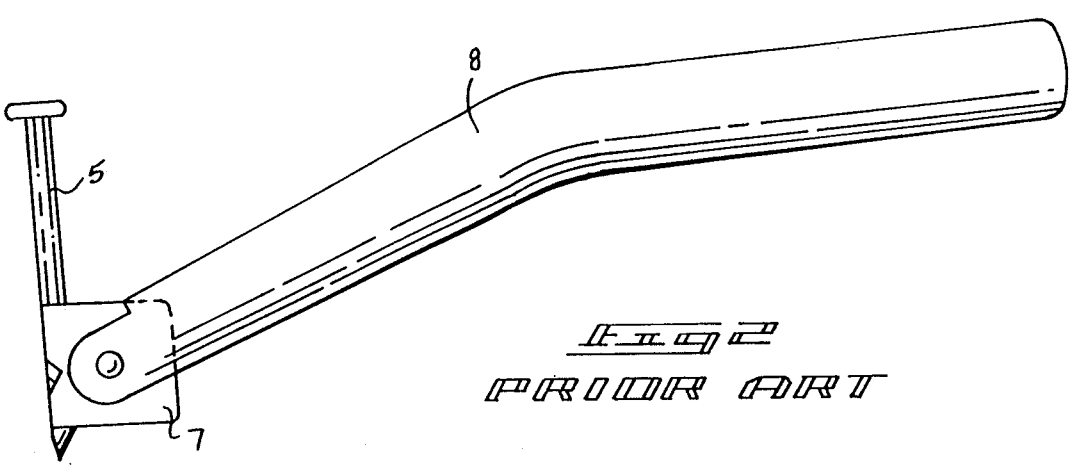
FIG. 2 PRIOR ART
FIG. 2 is an orthographic side view taken elevation of a further prior art nail support apparatus.

FIG. 1 is illustrative of a prior art nail support apparatus 10 utilizing a wooden handle 2 formed with elongate rod 3 mounting a plurality of spaced jaws 4 to secure a nail 5 to a foremost end thereof. FIG. 2 illustrates a prior art nail support device 6 utilizing a generally elongate angular handle 8 formed with a magnetic head 7 at foremost end thereof provided with a slot to receive a nail 5 therewithin and position the nail during a nailing procedure.

More specifically, the nail support apparatus 10 as illustrated in FIG. 3 essentially comprises a elongate cylindrically aligned handle 11 formed with a coaxially extending cylindrical extension rod 12 defined by a diameter less than of the handle 11. A cylindrical magnetic head 13 formed coaxially to a forward most post end of the rod 12. A diametrically aligned v-shaped notch 14 is mounted across a forward end surface of the head 12 to secure nail 5 therewithin. The head 13 is of a somewhat larger diameter than that of the rod 12 to provide a weighted end thereby affording better balance to the organization in use. The handle 11 is substantially 4.5 to 5 inches in diameter with the extension rod 12 substantially in the range of 8 to 10 inches in length to properly position the nail 5 in a convenient orientation relative to a user of the device.

FIG. 4 illustrates a modified nail support apparatus **10*a* provided with an angular mounting plate 15 to afford a greater degree of protection to a individual's hand defining a shield with a generally u shaped handle 16 orthogonally extending outwardly from an exterior surface of the plate 15. The plurality of spaced first and second respective longitudinally aligned wound spring extension rods 12*a* and 12*b* are fixedly and orthogonally mounted to a forward face of the plate 15 along the common diameter thereof. The extension rods 12*a* and 12*b* are mounted with the cylindrical magnetic heads 13 formed with the associated notches 14. The upper and lower notches 14 of the upper and lower extension heads 13 of the associated extension rods 12*a* and 12*b* are aligned to receive a nail 5 in an aligned manner therebetween. This construction affords a greater degree of stability in securing a nail for a nailing procedure. Further, in the inadvertent event of a missed hammer strike, the wound spring rods 12*a* and 12*b*** are of a memory retentent construction to provide a spring-back feature enabling the rods to resume their original configuration subsequent to the strike.

Figure 5:
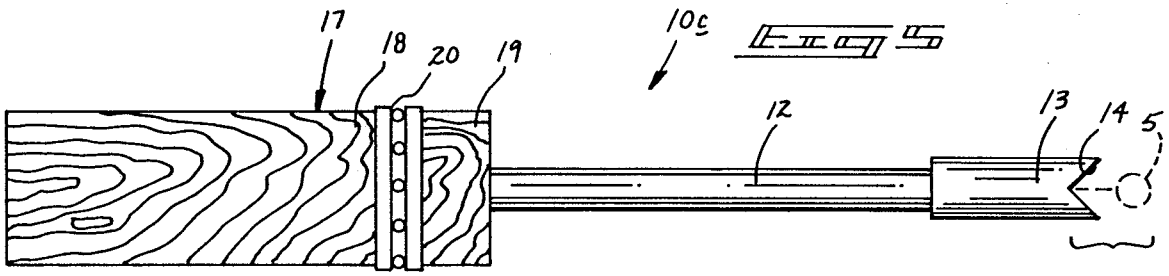
FIG. 5 is an orthographic top view of a modified handle utilized by the instant invention.

FIG. 5 illustrates a modified nail support apparatus **10*c* incorporating all of the salient features of the invention illustrated in FIG. 3 including a modified handle 17. The modified handle includes a cylindrical upper portion 18 coaxially aligned with the cylindrical lower portion 19. A bearing member 20 rotatably mounts the upper and lower portions 18 and 19 together. The bearing 20** provides a frictionally rotative engagement between the upper and lower portions to maintain a positioning of the relative orientation of the upper and lower portions but still allows a user to rotate a user grip on the upper portion during a nailing procedure.

Figure 6:
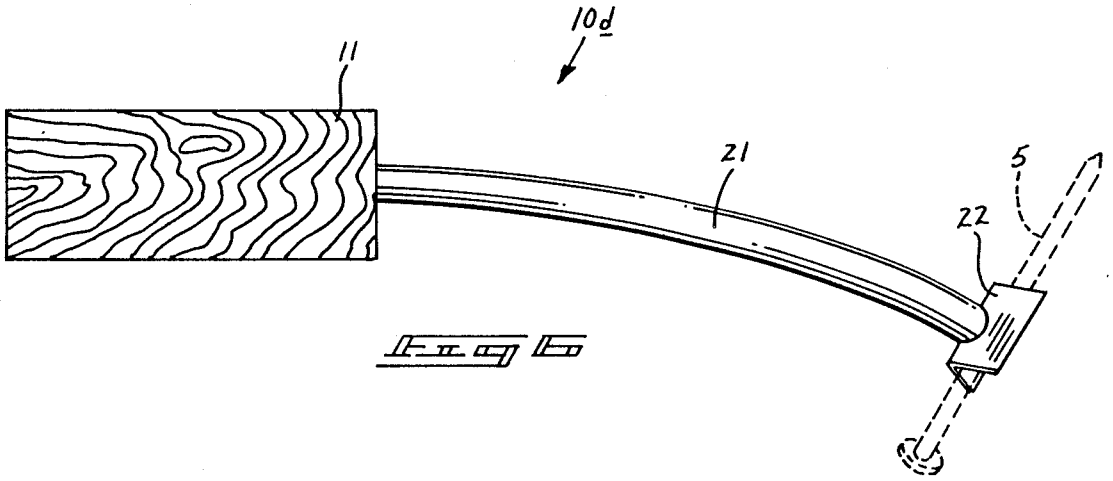
FIG. 6 is an orthographic top view of a modified extension rod utilized by the instant invention.
Figure 11:
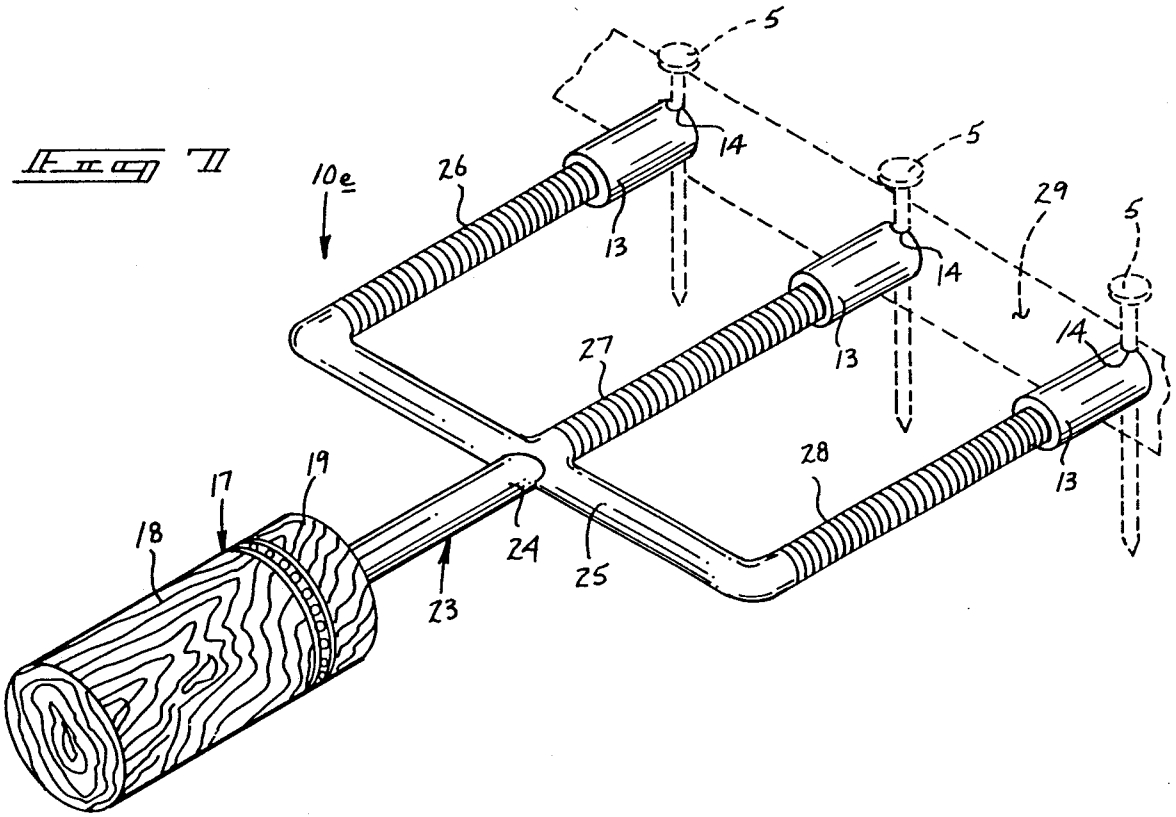
Figure 11:
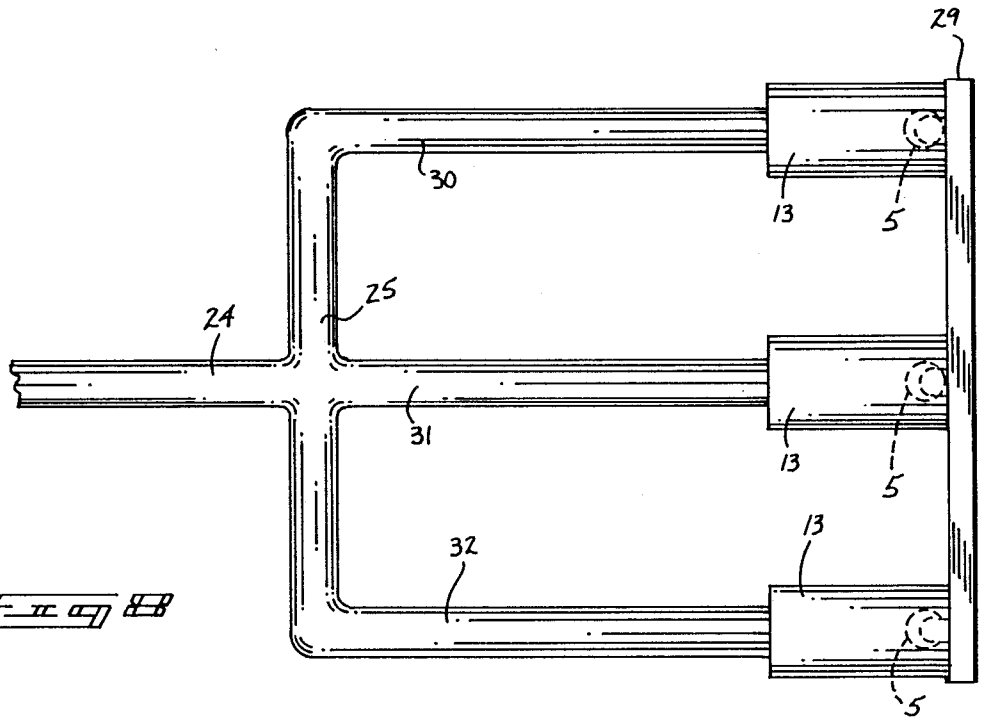

FIG. 6 illustrates a further modified apparatus **10*d* wherein the handle 11 is oriented to coaxially secure an arcuately configured extension rod 21 that mounts a v-shaped magnetic plate 22 at a forward end thereof to receive a nail 5 in instances requiring enhanced vision by an individual to properly strike the associated nail 5**.

FIG. 7 illustrates the modified nail support apparatus **10*e* utilizing the handle structure of FIG. 5 provided with a rotatably oriented upper portion adjacent to the lower portion 19. A T-shaped extension rod 23 extends forwardly of the handle 17. The extension rod 23 includes an axially aligned first shank 24 with a second shank 25 orthogonally and fixedly mounted medially of its length to a forward terminal end of the first shank 24. A first, second, and third longitudinally aligned wound spring extension rod 26, 27, and 28 respectively extend orthogonally of the second shank 25 at each of its ends and medially thereof wherein the first and third extension rods 26 and 28 are positioned at terminal ends of the second shank 25 with the second rod 27 extending coaxially of the first shank 24. A magnetic head 13 is mounted at a forward terminal end coaxially thereof of each of the first, second, and third rods 26, 27, and 28. Each of magnetic heads includes the v-shaped notch 14 which is aligned orthogonally relative to the alignment of the second shank 25. The predetermined spacing between the heads 13 accommodates a predetermined nailing spacing desired such as a 5 inch center, 6 inch center and the like. A lock plate 29 is utilized (See FIG. 8) to insure securement of each of the nails 5 within the associated groove 14 as the lock plate 29 is of a material to magnetically adhere to the heads 13 to insure locking of the nails 5 there within to prevent their dislodgement from the notches 14 due to vibration and the like. FIG. 8 illustrates essentially the embodiment of FIG. 7 utilizing rigid legs 30 without the advantage of employing the shock absorbing physical features of the extension rods as illustrated in FIG. 7**.

Absolute manner of usage and operation of the instant invention, same to be apparent from the above disclosure and accordingly no further discussion relative to the manner of usage and operation of the incident invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A nail support apparatus comprising, a cylindrical handle including a forward end surface and a rear end surface, and a longitudinally aligned rod extension means integrally and orthogonally mounted to the forward end surface, and a magnetic nail support means integrally mounted to a forward end of the rod extension means for selective securement of a nail member thereto, and wherein the cylindrical handle defines an annular plate, and the forward end surface and the rear end surface are planar, and a "U" shaped handle orthogonally mounted to the rear end surface and diametrically aligned with the annular plate, and wherein the rod extension means includes a first and a second longitudinally aligned wound spring extension rod wherein the first and second longitudinally aligned wound spring extension rods are spaced parallel to one another and mounted upon a common diameter of the forward end surface of the annular plate.

2. Apparatus set forth in claim 1 where each longitudinal wound spring extension means includes a magnetic nail support means mounted thereon, each magnetic nail support means defines an cylindrical body with a v-shaped notch formed within a forward surface of the cylindrical body where each cylindrical body is coaxially aligned with each longitudinally wound spring extension rod, and each v-shaped notch is longitudinally aligned relative to each other to receive a single nail therebetween.

3. A nail support apparatus comprising, an elongate cylindrical handle including a forward end surface and a rear end surface, and a longitudinally aligned rod extension means integrally and orthogonally mounted to the forward end surface, and a magnetic nail support means integrally mounted to forward end of the rod extension means for selective securement of a nail member thereto, and wherein the cylindrical handle includes an upper end portion rotatably mounted to a lower end portion, the upper end portion and the lower end portion coaxially aligned relative to one another including a rotatably bearing mounted therebetween to enable rotation of the upper end portion relative to the lower end portion, and the rod extension means includes a "T" shaped member, and wherein the "T" shaped member includes a first shank longitudinally aligned with the handle and a second shank orthogonally mounted to the first shank with the first shank medially bisecting the second shank, and a first longitudinal rod extension and a second longitudinal rod extension, and a third longitudinal rod extension mounted orthogonally to the second shank with the first and third rod mounted orthogonally to terminal ends of the extension shank and the second longitudinal rod mounted coaxially with the first shank orthogonally mounted to the second shank, where the first, second, and third longitudinal rods are each parallel to one another and equally spaced apart.

4. An apparatus set forth in claim 3 where each longitudinal rod is formed as a longitudinally wound spring to accommodate vibration and shock thereon.

5. An apparatus set forth in claim 4 where in each longitudinal rod includes a cylindrical magnetic head longitudinally and coaxially aligned to each longitudinal rod, and each head includes a V-shaped notch formed within a forward surface of each head, each V-shaped notch orthogonally aligned relative to the second shank.

6. An apparatus set forth in claim 5 further including a planar lock plate defining a length to span a predetermined distance defined between the first, second, and third longitudinal rod mounted to selectively overlie the forward surface defined by each magnetic head and V-shaped notch, and wherein the plate is magnetically adhereable to each forward surface of each head to lock a respective nail mounted within each V-shaped notch.

* * * * *